United States Patent [19]

VanHorne

[11] Patent Number: 4,568,073

[45] Date of Patent: Feb. 4, 1986

[54] PAPER HANDLING APPARATUS FOR A COPIER

[75] Inventor: Arthur C. VanHorne, Lake Oswego, Oreg.

[73] Assignee: Tektronix, Inc., Beaverton, Oreg.

[21] Appl. No.: 694,894

[22] Filed: Jan. 24, 1985

Related U.S. Application Data

[63] Continuation of Ser. No. 444,123, Nov. 24, 1982, abandoned.

[51] Int. Cl.[4] ..... B65H 5/08

[52] U.S. Cl. ..... 271/11; 271/94; 271/98

[58] Field of Search ..... 271/5, 11, 97, 98, 105, 271/106, 107, 94, 95, 96, 276

[56] References Cited

U.S. PATENT DOCUMENTS

| | | | |
|---|---|---|---|
| 3,669,445 | 6/1972 | Wallis | 271/106 |
| 3,865,364 | 2/1975 | Sterner | 271/105 |
| 3,942,788 | 3/1976 | Boyle | 271/276 |
| 3,964,740 | 6/1976 | Lamb | 271/11 |
| 4,025,178 | 5/1977 | Yokozawa et al. | 355/3 R |
| 4,050,805 | 9/1977 | Hage | 355/14 |
| 4,073,585 | 2/1978 | Kobayashi et al. | 355/14 |
| 4,118,024 | 10/1978 | Gerhardt | 271/5 |
| 4,141,545 | 2/1979 | Schnall et al. | 271/118 |
| 4,190,354 | 2/1980 | Smith et al. | 355/3 SH |
| 4,218,129 | 8/1980 | Ishimoto et al. | 355/14 SH |
| 4,261,661 | 4/1981 | Thiers | 355/24 |
| 4,310,151 | 1/1982 | Fujimoto | 271/11 |
| 4,345,752 | 8/1982 | Nakamura et al. | 271/94 |
| 4,382,593 | 5/1983 | Beran et al. | 271/98 |
| 4,402,497 | 9/1983 | Weibel et al. | 271/11 |

*Primary Examiner*—Bruce H. Stoner, Jr.
*Assistant Examiner*—John A. Carroll
*Attorney, Agent, or Firm*—Francis I. Gray; John H. Bouchard

[57] ABSTRACT

A paper handling system for a copier is disclosed. A paper sheet is wrapped around a drum of a copier by utilizing the exhaust air flow of a vacuum to lift the paper to the drum and to hold the paper sheet onto the drum. In addition, if a second paper sheet is lifted to the drum in a double pick situation, the second sheet is returned to a paper tray for subsequent copying thereon.

3 Claims, 33 Drawing Figures

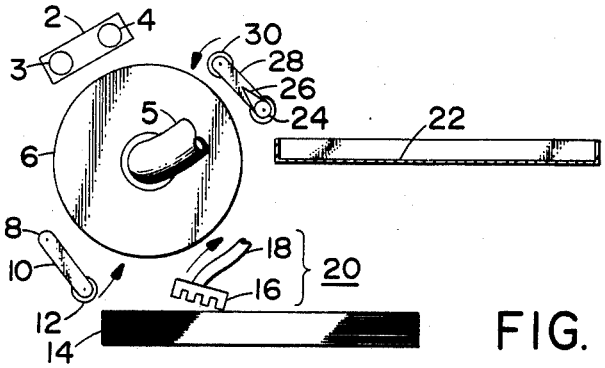
FIG. 1.
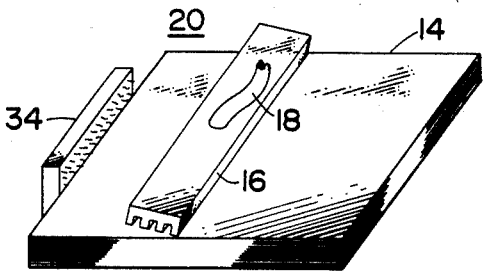
FIG. 2A.
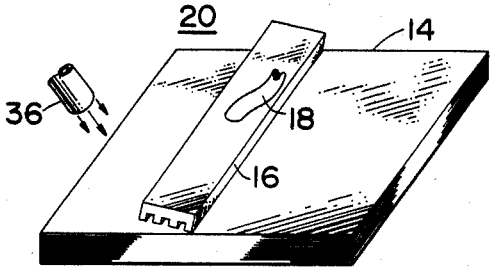
FIG. 2B.
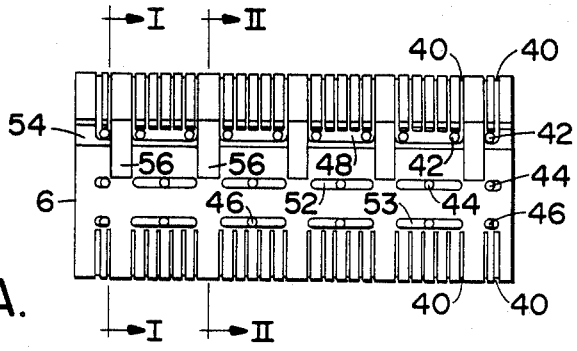
FIG. 3A.
FIG. 3B.
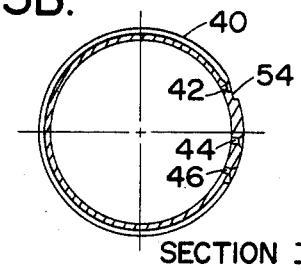
SECTION I-I
FIG. 3C.
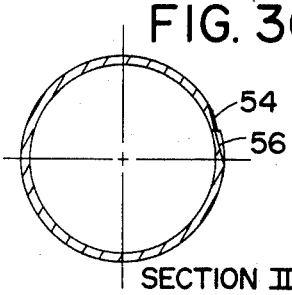
SECTION II-II FIG. 4A.
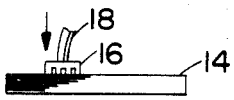
FIG. 4B.
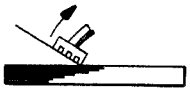
FIG. 4C.
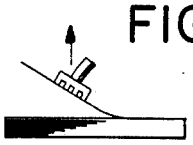
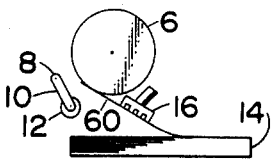
FIG. 5A.
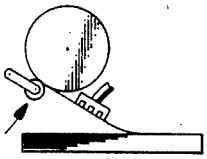
FIG. 5B.
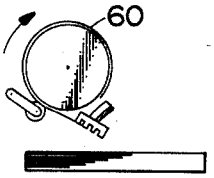
FIG. 5C.
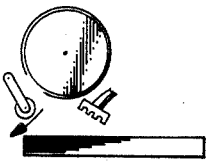
FIG. 5D.
FIG. 6B.
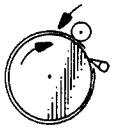
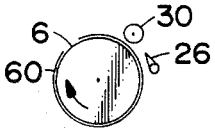
FIG. 6A.
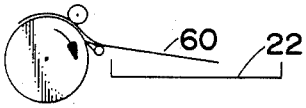
FIG. 6C.
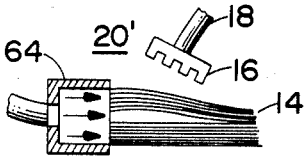
FIG. 7A.
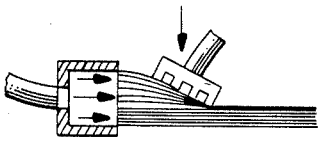
FIG. 7B.
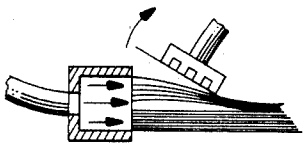
FIG. 7C.
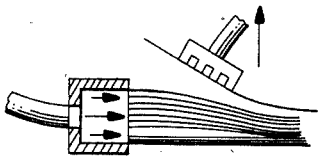
FIG. 7D.

FIG. 8A.
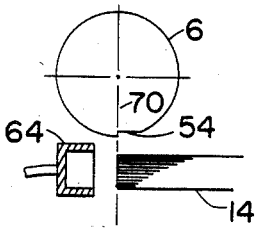
FIG. 8B.
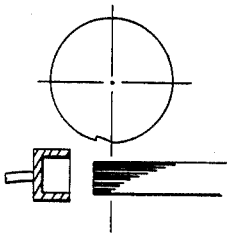
FIG. 8C.
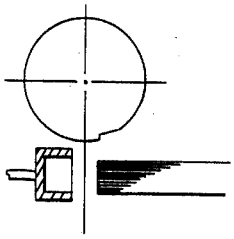
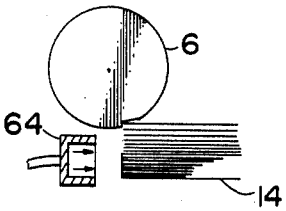
FIG. 9A.
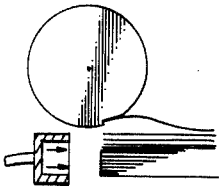
FIG. 9B.
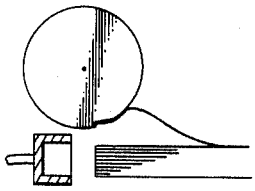
FIG. 9C.
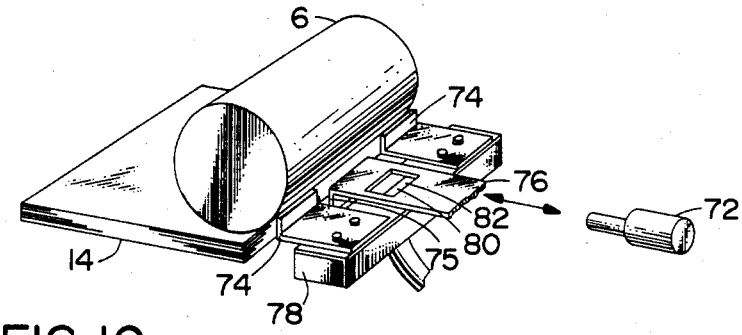
FIG. 10.

PAPER HANDLING APPARATUS FOR A COPIER

This a continuation of application Ser. No. 444,123 filed Nov. 24, 1982 and now abandoned.

BACKGROUND OF THE INVENTION

1. Field of the Invention

The present invention relates generally to a responding apparatus, or copier, more specifically, to a paper handling system for said copier for loading and unloading a sheet of recording paper from a paper stack to and from a printing drum.

2. Description of the Prior Art

For a drum type copier, automatic paper handling requires that paper be fed automatically from a paper stack to a drum, be loaded thereonto and be unloaded or removed therefrom. A common technique used for automatic paper handling involves the utilization of friction associated with a rubber roller or a rubber belt. Disadvantages of the technique include paper jam, double feeding, oblique feeding and other feeding problems resulting from differences in paper weight, surface conditions, etc. Therefore, this technique is not suitable for different types of paper. Another technique used for automatic paper handling (or feeding) involves the use of a vacuum, such as that which is shown in laid open Japanese patent application No. 101719/76. Said another technique utilizes a paper feeding apparatus including a rotary cam and a sucking means driven by the cam via an arm, for sucking the top sheet from a stack of paper and supplying the sheet to a set of transfer rollers. This apparatus often experiences a problem involving the feeding of more than one sheet. In addition, since said sheet is transferred to the next stage via transfer rollers, the above-mentioned disadvantages associated with the former technique may also be caused to occur with respect said another technique.

Other automatic paper loading techniques are also disclosed, for example, techniques disclosed in laid open Japanese utility model application Nos. 75345/74 and 56826/78. In the former technique, a holding means is provided on a drum surface along a longitudinal axis thereof for holding a leading edge of a paper sheet. The holding means opens, when driven by a cam, at a specified rotational position of the drum in order to accept the leading edge of the sheet. The paper sheet held by the holding means is wrapped around the drum due to the rotation of the drum. It is, however, difficult to provide a high quality recorded image on said paper sheet because the sheet is not tightly mounted on the drum surface. In the latter technique, a second holding means is provided to hold the trailing edge of the sheet. However, a new problem is created related to limitation of paper size useable for said copier.

SUMMARY OF THE INVENTION

It is, therefore, an object of the present invention to provide a paper handling system capable of automatic paper handling for a drum type copier.

It is another object of the present invention to provide a paper handling system for a copier capable of handling various types of sheets.

It is still another object of the present invention to provide a paper handling system for a copier capable of minimizing the possibility of paper jams, double feeding and any other feeding troubles.

Other objects and the resulting advantages of the present invention will become apparent upon reading the following description by reference to the accompanying drawings.

BRIEF DESCRIPTION OF THE DRAWINGS

A full understanding of the present invention will be obtained from the detailed description given hereinbelow, and the accompanying drawings, which are given by way of illustration only and thus are not limitative of the present invention, and wherein:

FIG. 1 is a simplified diagram of a paper handling system for a copier in accordance with the present invention.

FIG. 2A illustrates a feeding means associated with the paper handling system for a copier in accordance with the present invention;

FIG. 2B illustrates another feeding means associated with the paper handling system for a copier in accordance with the present invention.

FIGS. 3A, 3B, and 3C illustrate three views of one example of a drum structure;

FIGS. 4A, 4B, and 4C illustrate a paper feeding process associated with the paper handling system shown in FIG. 1.

FIGS. 5A, 5B, 5C and 5D illustrate a paper loading process associated with the paper handling system of FIG. 1.

FIGS. 6A, 6B, and 6C illustrate a paper removing process associated with the paper handling system of FIG. 1.

FIGS. 7A, 7B, 7C, and 7D illustrate a sequence of steps associated with another paper feeding means according to the present invention;

FIGS. 8A, 8B, and 8C illustrate another embodiment of a paper feeding means according to the present invention showing three potential positions of a paper stack relative to a vertical line through the center of a drum on which the paper is to be loaded.

FIGS. 9A, 9B, and 9C illustrate a paper loading process associated with the embodiment of FIG. 8C.

FIG. 10 illustrates a perspective view of still another paper feeding and loading means according to the present invention.

DETAILED DESCRIPTION OF THE PREFERRED EMBODIMENT

Figure 11A:
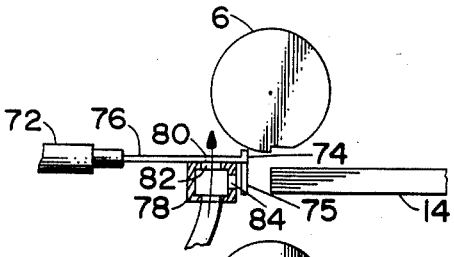
FIGS. 11A, 11B, 11C, 11D, 11E, and 11F illustrate various steps of a paper feeding and loading process associated with the paper feeding and loading means shown in FIG. 10.

Another type of copier is an ink jet printer capable of printing both in monochrome and multiple colors. FIG. 1 illustrates a simplified diagram of an ink jet printer in accordance with the present invention. In FIG. 1, a single sheet of paper is picked up from a paper stack 14 by a paper feeding means 20, the paper feeding means loading the single sheet of paper onto a drum 6. Feeding means 20 includes a pick 16 and a vacuum pump tube 18, the vacuum pump tube 18 being coupled to a vacuum pump means (not shown), such as a three-stage centrifugal blower. Drum 6 is also connected to an identical vacuum pump means via a hose 5. Air, residing in drum 6, is drawn therefrom. Openings are provided on the surface of drum 6 in order to suck up the paper, picked by feeding means 20, and to hold the paper tightly around the drum. When a leading edge of the paper is sucked onto drum 6, the edge starts to rotate with the drum. As a result, the paper wraps around the drum surface. Idler roller 12 is provided to aid in the paper loading. After completion of paper loading, the rotation of drum 6 is accelerated to a predetermined printing speed suited for printing by an ink jet head mounted on a carriage 2. The carriage 2 is mounted on rails 3, 4, and is scanned along the drum axis via said rails. When the printing is completed, drum 6 is decelerated. The printed paper is unloaded from drum 6 by stripper fingers 26 and is routed into output tray 22. A pair of idler rollers 30 are provided to aid in the paper removal.

Shown in FIGS. 2A and 2B are two embodiments of a feeding means 20, illustrated in a magnified scale, the feeding means 20 including means for avoiding the double paper feeding problem. The FIG. 2A embodiment uses a brush member 34 in contact with at least the front edge of a paper stack 14. In FIG. 2B, the brush member 34 is replaced by an air tube 36 positioned to blow air onto the front edge of the paper stack 14.

FIG. 3A illustrates one example of a front view of drum 6. Openings 42 are formed with concave portions 48 around the openings on drum 6 and along the drum axis for sucking up the leading edge of a sheet of paper. Notch 54 is also formed on the drum surface along the drum axis including openings 42.

The purpose of notch 54 is to recess the leading edge of the sheet of paper slightly below the drum surface in order to protect the leading edge from an airstream. Otherwise, the airstream would tend to lift the sheet off the drum at high speeds.

In order to fix the trailing edge of the sheet of paper, openings 44 with concave portions 52 and openings 46 with concave portions 53 are provided, respectively, in parallel with notch 54. The two parallel openings 44 and 46 allow the operator to use different size sheets. A multitude of grooves 40, continuing to concave portion 48, are formed around the drum surface for tightly mounting the paper thereon. FIGS. 3B and 3C are section views of drum 6 along lines I—I and II—II. The leading edge of the paper is loaded onto notch 54. Slope portions 56 formed on the drum surface across notch 54 are provided for ease of the paper removal.

FIGS. 4A through 4C illustrate the process of paper feeding. Firstly, pick 16 is dropped down on top of paper stack 14 to cause the top sheet to be sucked toward pick 16 (FIG. 4A). Pick 16 then pivots about 30° on top of the stack (FIG. 4B). The resulting bending of the paper in combination with the action of brush member 34 or air tube 36 assures that only one sheet will adhere to pick 16. The sheet is then lifted away from paper stack 14 (FIG. 4C) and the paper feeding is complete. The motion of pick 16 may be controlled by conventional means (not shown), such as a combination of a pair of cams coupled to a cam shaft, a motor for rotating the cam and a pair of arms, each rotatably coupled at one end to a pivot shaft and the other end coupled to pick 16 for actuating pick 16. Also pick 16 may include shafts at both sides thereof to slide within vertical slots provided in side frames (not shown).

FIGS. 5A through 5D illustrate the process of paper loading onto drum 6. Drum 6 was rotated to the correct initial angular position and the vacuum for drum 6 was turned on at the beginning of the paper feeding. When the paper has been picked and is in a loaded position under notch portion 54 of drum 6, idler roller 12 is pivoted into position so that it presses paper 60 against the drum surface (FIG. 5B). The vacuum of pick 16 is then turned off and drum 6 is rotated at a low speed for one revolution (FIG. 5C), thus pulling paper 60 past pick 16 and wrapping it around drum 16. The only driving force required to load paper 60 on drum 6 is the rotation of the drum itself. Idler roller 12 prevents paper 60 from slipping relative to the drum surface. Idler roller 12 is then pivoted back to its original position (FIG. 5D) to complete the paper loading process. Then, the rotational acceleration of drum 6 increases to the printing speed. The motion of idler roller 12 may be controlled by lever 10 which pivots around pivot shaft 8 driven by motor-driven cams or a solenoid.

FIG. 6 illustrates the process of unloading the paper from drum 6. When the printing is completed, drum 6 is decelerated to a slower speed (FIG. 6A), and stripper fingers 26 and idler rollers 30 are pivoted toward the drum surface. Stripper fingers 26 touch the drum surface at slope portions 56 (See FIG. 3A) between the ends of paper 60 (FIG. 6B). As drum 6 continues to rotate, the leading edge of paper 60 rides over stripper fingers 26 and paper 60 is routed into output tray 22 (FIG. 6C). Idler rollers 30 maintain paper 60 in contact with drum 6 after the leading edge is broken loose by stripper fingers 26 so that the only driving force required to move the paper into output tray 22 is the rotational force of the drum itself. Since idler rollers 30 only contact the margins of the recorded image on paper 60, the possibility of ink contamination is effective eliminated. The drum vacuum is maintained in order to keep the trailing edge of the paper mounted on drum 6 until all of the paper has been removed by stripper fingers 26. The motions of stripper fingers 26 and idler rollers 30 are controlled by pivot shaft 24 and by lever 28 (which are omitted in FIG. 6 for simplicity) and are driven by conventional drive means. Idler rollers 30 may be removed if enough vacuum is present on the drum surface in order to prevent paper 60 from slipping therefrom.

Referring now to FIGS. 7A thru 7D, there is shown another paper feeding means 20' associated with the paper handling system according to the present invention. This is similar to paper feeding means 20 shown in FIGS. 2A and 2B except that: double pick protection means 34 or 36 is replaced by air manifold 64 having several discharge vents positioned at the front end of paper stack 14, and the motion of pick 16 is modified. The pick motion is designed such that the gap between the front edge of pick 16 and paper stack 14 remains constant regardless of whether pick 16 is resting on the top of a full stack of paper or on the final sheet. The vacuum exerted by pick 16 is not of itself sufficient to suck a piece of paper across the gap and onto pick 16. An air flow from manifold 64 is provided so as to float the top several sheets of paper, thereby separating them from each other and from the remainder of paper stack 14. The characteristics of the floating sheets of paper are such that, when pick 16 is dropped onto the stack, the top sheet is forced into contact with the entire vacuum surface of pick 16 and is sucked thereonto. Because of the air separating the top few sheets, none of the other sheets are sucked onto pick 16. The pick 16 is then pivoted until about 30° from the horizontal, and the sequence continues as previously described. By this paper feeding means, the possibility of causing the "double pick" problem to occur is effectively eliminated, especially when porous paper is utilized.

FIGS. 8A through 8C illustrate yet another paper feeding and loading means associated with the paper handling system according to the present invention. Manifold 64 is used to float the sheets of paper up to drum 6, where the top sheet is sucked against notch 54 of drum 6. When this seal has taken place, airflow through manifold 64 is turned off and all the sheets settle back into the tray except for the one held by vacuum against notch 54 of the drum. Drum 6 is than rotated and accelerated to printing speed to wrap the sheet around drum 6. The sides and back of the paper tray (not shown) are tall enough to keep the sheets properly positioned as the air layer lifts them into contact with drum 6. The relative position of paper stack 14 and drum 6 has an affect on the tendency to double pick, i.e., to pick two (2) sheets of paper. FIG. 8A illustrates how the double pick is most likely to occur, wherein the front end of paper stack 14 is positioned just on the drum center line 70. FIG. 8B illustrates how the double pick is less likely to occur, wherein the front end of paper stack 14 is positioned before center line 70, and FIG. 8C illustrates how the double pick is least likely to occur, wherein the front end is positioned behind center line 70.

FIGS. 9A through 9C illustrate the paper feeding and loading process of the configuration shown in FIG. 8C. Drum 6 is indexed to the loading position. Manifold 64 flows air in order to float the top several sheets of paper up to drum, 6 and the top sheet is ready to be sucked on to drum 6 (FIG. 9A). The top sheet is then sealed to drum 6, causing it to curve slightly relative to other sheets due to paper stack 14 being positioned behind drum center line 70 (FIG. 9B). Manifold 64 is then turned off to allow other sheets to settle back on paper stack 14. As the top sheet settles back, except for the front end held on drum 6, the curvature of the sheet increases as shown in FIG. 9C. This final motion assists in the separation of the second sheet from the first sheet in a double pick situation.

FIG. 10 is a perspective view of still another paper feeding and loading means associated with the paper handling system according to the present invention. Manifold 64 is slightly modified in that manifold 64 further includes fluffer box 78, and solenoid-operated valve plate 76. Guides 74 are added to the paper feeding and loading means shown in FIG. 8. Fluffer box 78 has vent hole 82 at the top portion and two small slits 84 in the front portion thereof. Valve plate 76 is actuated forward and backward on vent hole 82 of fluffer box 78 and has opening 80 at the position corresponding to vent hole 82 when valve plate 76 is in the pulled position. Paper pusher 75 is provided by bending the free end of valve plate 76.

Figure 11B:
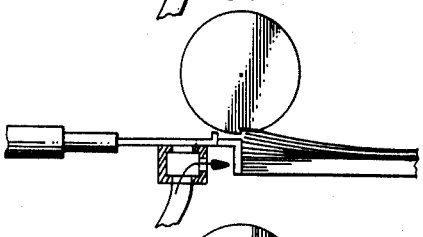
Figure 11C:
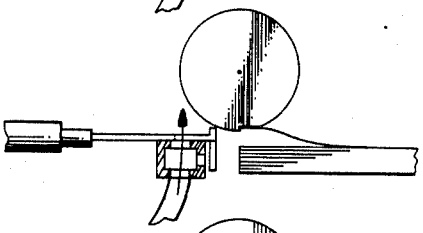
Figure 11D:
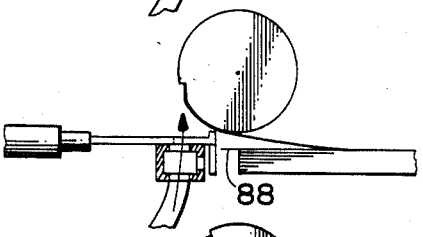
Figure 11E:
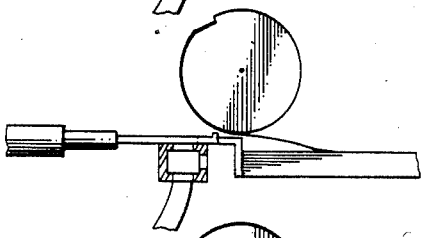
Figure 11F:
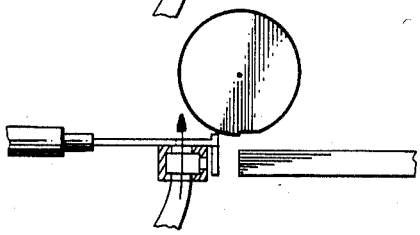

Referring to FIGS. 11A through 11F, the paper feeding and loading process associated with the paper feeding and loading means shown in FIG. 10 is described hereinafater. Drum 6 is indexed to a loading position. Valve plate 72 is in the pulled position and exhaust air flows straight out through vent hole 82 and opening 80 (FIG. 11A). Valve plate 72 is then pushed forward to block vent hole 82 and air is forced through slits 84 in front of fluffer box 78, thereby raising several sheets of paper up to drum 6 to cause the top sheet to be sucked onto drum 6 (FIG. 11B). Paper pusher 75 has no function at this stage. Valve plate 76 is then returned to the original position and air flows out the top of fluffer valve 78 again. Thus all sheets settle back to paper stack 14 except the one sheet sucked onto drum 6 (FIG. 11C). Drum 6 is then rotated and accelerated to the printing speed in order to load the paper onto drum 6. Even if a double pick has been caused to occur, second sheet 88 falls as drum 6 rotates, and is guided down in front of paper pusher 75 by guides 74 (FIG. 11D). As the load cycle continues, solenoid 72 is actuated again to cause paper pusher 75 to push extra sheet(s) 88 back onto paper stack 14 for reuse (FIG. 11E). Fluffing action caused at this time does not interfere with the paper loading because the air flow is greatly reduced due to the loaded sheet blocking the openings in drum 6 and because, the solenoid is turned off too quickly to float up the sheets on paper stack 14. Valve plate 72 is returned and the paper loading is completed (FIG. 11F). Guides 74 serve a second function, that of holding the trailing edge of the sheet close enough to drum 6 so that it can be sucked onto drum 6 by trailing edge openings 44 and 46.

According to the present invention, highly reliable automatic paper handling for a drum type copier is achieved. The paper path in the copier is kept as short as possible, that is, the paper on the paper stack is directly loaded from the paper stack onto the drum and is directly routed from the drum to an output tray after printing. Thus, the conventional paper transport systems found in most copiers are eliminated, so the possibility of a jam is minimized and also the entire dimension and cost of the copier is greatly reduced. Various types of the sheets of different sizes, weight, surface condition are usable by the paper handling system of the present invention. Since the paper stack does not have to be lifted up to the paper feeding means by a spring or other means, as in some conventional copiers, the differences in weight of the paper stack will have no effect on the performance of the system. As to transparencies with separator sheets, the separator sheets will follow the same path as the transparencies. The differences between transparencies and separator sheets are optically determined by conventional means. Thus, the transparencies will have the separator sheets between them both before and after printing for full protection against damage to the coated surface. Also, because the picked sheet is automatically placed in the proper position for loading, there is no need for sensing the leading edge of the paper.

While there have been shown and described various preferred embodiments of the present invention, it is obvious to those skilled in the art that many changes and modifications may be made without departing from the spirit and the scope of the present invention.

What I claim as novel is:

1. A paper handling system for a copier for automatically entraining a topmost sheet of recording paper from a recording paper stack onto the circumference of a vacuum drum for imaging or printing thereon while so entrained, the paper handling system comprising:

a vacuum drum substantially in the shape of a right circular cylinder having a notch along a line running the length of the outer surface of said vacuum drum for indexing a leading edge of said topmost sheet of recording paper to be loaded onto said vacuum drum, said notch having an array of openings therein for communicating vacuum inside said vacuum drum to the outer surface of said vacuum drum;

vacuum pump means for creating a vacuum in said vacuum drum;

a paper tray for holding said stack of sheets of recording paper therein, with said topmost sheet of said stack having an edge which is located below said vacuum drum but which is offset horizontally from a vertical plane passing through the center line of said vacuum drum when said topmost sheet is in said paper tray; and fluffer means located opposite said paper tray for blowing air laterally against said leading edge of said topmost sheet to float said leading edge of said topmost sheet to close proximity of said vacuum drum where it can be directly captured in said notch and entrained on the circumference of said vacuum drum.

2. An apparatus for automatically loading a sheet of paper onto a vacuum drum comprising:

means for holding a stack of said sheets, a leading edge of said sheet being situated below said vacuum drum and offset horizontally from a vertical plane through the center of said vacuum drum; and means located opposite said holding means for blowing air laterally against said leading edge to float said leading edge to close proximity of said vacuum drum for capture by said vacuum drum, said blowing means including means for directing air in one of at least two directions, a first direction being laterally against said leading edge and a second direction being away from said leading edge, and means integral with said directing means for pushing on said stack to align said stack when said directing means directs air in said first direction.

3. An apparatus as recited in claim 2 wherein said blowing means further comprises a box running substantially the length of said vacuum drum, said box having a first opening in said box opposite said holding means and a second opening such that when air is blown in said first direction by said directing means the air flows through said first opening, and when air is blown in said second direction the air flows through the said second opening.

* * * * *